United States Patent [19]

Beebe et al.

[11] 4,430,426

[45] Feb. 7, 1984

[54] STABILIZATION OF SILVER HALIDE EMULSIONS

[75] Inventors: George W. Beebe, Roseville; Philip Hine, St. Paul; Nelson B. O'Bryan, Maplewood; Steven M. Shor, St. Paul, all of Minn.

[73] Assignee: Minnesota Mining and Manufacturing Company, St. Paul, Minn.

[21] Appl. No.: 385,276

[22] Filed: Jun. 4, 1982

[51] Int. Cl.[3] ..... G03C 1/06

[52] U.S. Cl. ..... 430/604; 430/605; 430/607; 430/611; 430/614; 430/608; 430/615

[58] Field of Search ..... 430/607, 611, 614, 608, 430/615, 604, 605

[56] References Cited

U.S. PATENT DOCUMENTS

| | | | |
|---|---|---|---|
| T882,019 | 1/1971 | Abbott . | |
| 2,232,707 | 2/1941 | Kendall | 95/7 |
| 2,319,090 | 5/1943 | Sheppard et al. | 95/7 |
| 2,393,763 | 1/1946 | Fallesen et al. . | |
| 2,444,605 | 7/1948 | Heimbach et al. | 95/7 |
| 2,566,659 | 9/1951 | Fry | 95/7 |
| 2,675,314 | 4/1954 | Vittum et al. | 95/6 |
| 2,839,405 | 6/1958 | Jones | 96/107 |
| 3,488,709 | 1/1970 | Sidebotham | 96/110 |
| 3,622,340 | 11/1971 | Lamon | 96/109 |
| 3,692,527 | 9/1972 | von Konig et al. | 96/109 |
| 3,720,516 | 3/1973 | Newell et al. | 96/110 |
| 3,725,077 | 4/1973 | Kuffner et al. | 96/109 |
| 3,982,948 | 9/1976 | Sato et al. | 96/109 |

FOREIGN PATENT DOCUMENTS

| | | | |
|---|---|---|---|
| 976411 | 10/1975 | Canada | 96/111 |
| 988052 | 4/1965 | United Kingdom | 430/607 |

*Primary Examiner*—Won H. Louie, Jr.

*Attorney, Agent, or Firm*—Donald M. Sell; James A. Smith; Mark A. Litman

[57] ABSTRACT

Silver halide emulsions lack stability in that their properties vary over a period of time. Various stabilizers have been used to reduce the rate and degree of variation. The combination of uracils and nitroso-substituted phenols has been found to provide a synergistic stabilization of speed in silver halide emulsions. Other stabilizers may be combined with those two classes to further improve the stability of the emulsion.

13 Claims, No Drawings

STABILIZATION OF SILVER HALIDE EMULSIONS

FIELD OF THE INVENTION

This invention relates to silver halide photographic emulsions and particularly to the stabilization of silver halide photographic emulsions against increased speed and lost contrast with aging.

BACKGROUND OF THE INVENTION

Silver halide is naturally sensitive to only limited portions of the electromagnetic spectrum and its sensitivity within the limited range is low. It is conventional in the photographic art to broaden the range of sensitivity by spectral sensitization of the silver halide grains using sensitizing dyes. It is also conventional to increase the sensitivity of the grains themselves by treating them chemically during growth or ripening or after formation. Chemical sensitization is traditionally performed with sulfur sensitizers (particularly thiosulfate) and gold compounds.

The compounds used in chemically sensitizing silver halide or their by-products remain in the silver halide emulsion or on the silver halide grains after chemical sensitization has been completed. This along with other materials and physical conditions allows additional changes in sensitivity to occur after formulation of the final silver halide emulsion. Although these changes may include an increase of speed on aging, such changes are undesirable. Users of photographic materials must be assured of photographic properties and particularly the speed and contrast of the material in order to properly use the photographic element. Uncontrolled increases in speed would lead to overexposure of film by users if subtle alterations in exposure were not made by the photographer. It would be far better if the speed of photographic films could be stabilized against changes with aging.

PRIOR ART

Many different classes of materials have been added to silver halide emulsions to alter their properties and to stabilize the properties thus obtained.

Amongst the many materials used in the preparation of silver halide grains are rhodium salts which are present during precipitation to increase the contrast of the emulsion. Both U.S. Pat. Nos. 3,720,516 and 3,982,948 teach the use of rhodium salts in precipitation of silver halide grains and the use of stabilizing compounds in the emulsion preparation or prior to ripening.

Amongst those materials used to stabilize silver halide emulsions, uracils (including within that generic term thiouracils) have been taught as stabilizers (e.g., U.S. Pat. Nos. 2,231,127; 2,232,707; 2,319,090; 3,622,340; 3,692,527; 3,837,857 and 3,982,948), as have metal salts such as cadmium bromide (U.S. Pat. No. 3,488,709), manganous salts (U.S. Pat. No. 3,720,516 and Canadian Patent No. 976,411), hydroxy-triazaindolizines (U.S. Pat. No. 2,444,605) nitroso derivatives of phenols (U.S. Pat. No. 3,725,077), cobalt and manganese chelates (U.S. Pat. No. 3,556,797), decomposition products of nucleic acids (U.S. Pat. No. 3,982,948) and many other materials. Each of these materials tend to have some beneficial effect in stabilizing silver halide, but only to a limited degree.

Antifoggants are also generally used in photographic emulsions to prevent the formation of spurious development sites on silver halide grains. The art teaches many different types of compounds as antifoggants, including the phenol derivatives (including aldoximes) of U.K. Pat. No. 988,052 and the fused cyclic structures of U.S. Pat. No. 2,566,659.

As previously mentioned, it is common practice to broaden the range of sensitivity by spectral sensitization of the silver halide grains using sensitizing dyes. The combination of sensitizing dyes (particularly the cyanine dyes which are the dyes of choice in the art) with silver halide emulsion, the grains of which were precipitated in the presence of rhodium salts, causes a particularly adverse effect. The combination of the dye and rhodium doped grains causes an increase in instability in the emulsion. The emulsion more rapidly increases its speed and loses contrast. This creates a serious problem in attempting to combine rhodium doped silver halide grains and merocyanine sensitizing dyes.

DISCLOSURE OF THE INVENTION

Brief Description of the Invention

Photographic emulsions can be stabilized against speed variations with aging by combining (a) lithium salts, (b) manganous salts, (c) pyrimidine stabilizers, (d) uracils or thiouracils and (e) nitroso derivatives of phenols. This stabilizer combination is particularly desirable in rhodium doped silver halide emulsions and most particularly in such emulsions sensitized with dyes, and particularly merocyanine sensitizing dyes. Such emulsions are particularly desirable as rapid access developable graphic arts photographic materials. The combination of the classes of (1) uracils or thiouracils and (2) the phenol derivatives by themselves show a synergistic effect. That effect is even better in combination with the other three classes of materials used as stabilizers.

DETAILED DESCRIPTION OF THE INVENTION

The stabilizer system of at least two and preferably five ingredients used according to the present invention are generally added to the light-sensitive silver halide emulsion after ripening. They may be added directly to the emulsion or, in part or in whole, provided from other layers within the photographic element. The concentration of the total amount of the stabilizer system may be varied within broad limits, with stabilization noted with 0.05 g to 12 g of stabilizer system to each gram mole of silver halide. Preferably between 0.1 to 10 g of stabilizer system per mole of silver halide is used.

The stabilizers according to the invention may be used in any silver halide emulsion. Suitable silver halides are silver chloride, silver bromide, silver chlorobromide or mixtures thereof, optionally with a small silver iodide content of up to 10 mole percent. The silver halide is generally coated at 1.5 to 10 g/m$^2$, preferably 2.5–7 g/m$^2$ and most preferably 3–5 g/m$^2$ on a substrate. Narrow grain sizes with an average diameter between 0.1–0.8 microns, preferably between 0.15 to 0.5 and most preferably between 0.20 and 0.30 microns are generally used. The silver halides may be dispersed in the usual hydrophilic compounds, for example, carboxymethyl-cellulose, alkyl cellulose, hydroxyethylcellulose, starch or its derivatives, carrageenates, polyvinyl alcohol, polyvinylpyrrolidone, alginic acid and its salts, esters or amides, and preferably gelatin. Such emulsions are particularly desirable as graphic arts photographic materials.

The combination of the classes of (1) uracils (including thiouracils) and (2) the phenol derivatives by themselves show a synergistic effect. That effect is even better in combination with the other three classes of materials used as stabilizers.

The emulsions may be chemically sensitized in the usual manner, for example, with salts of noble metals such as gold, ruthenium, rhodium, palladium, iridium or platinum. Sensitization with gold salts is described in the article by R. Koslowsky, Z. Wiss. Phot. 46, 65–72 (1951).

The emulsions may also be chemically sensitized, e.g. by the addition of compounds which contain sulfur during chemical ripening, for example, allylisothiocyanate, allyl thiourea, sodium thiosulfate or the like. Reducing agents, e.g. the tin compounds described in Belgian Pat. Nos. 493,464 and 568,687, or polyamines such as diethylene triamine or aminomethylsulfinic acid derivatives, e.g. those mentioned in Belgian Patent No. 547,323, may also be used as chemical sensitizers.

The emulsions may also be sensitized with polyalkylene oxide derivatives, e.g. with polyethylene oxide having a molecular weight of between 1000 and 20,000, with condensation products of alkylene oxides and aliphatic alcohols or glycols or cyclic dehydration products of hexitols, or with alkyl substituted phenols, aliphatic carboxylic acids, aliphatic amines, aliphatic diamines and amides. The condensation products have a molecular weight of at least 700 and preferably more than 1000. These sensitizers may, of course, also be combined in order to achieve special effects, as described in Belgian Pat. No. 537,278 and in British Pat. No. 727,982. The use of polyalkylene oxides in amounts of 0.1 to 2 grams per mole of silver is particularly desirable to enable lithographic processing.

The emulsions may also be optionally sensitized, e.g. with the usual polymethine dyes such as neutrocyanines, cyanines, merocyanines, basic or acid carbocyanines, rhodacyanines, hemicyanines, styryl dyes, oxonoles and the like. Sensitizers of this type have been described in the work by F. M. Hamer "The Cyanine Dyes and Related Compounds" (1964).

Merocyanine dyes are well known in the photographic art as spectral sensitizing dyes. General teachings of these dyes include U.S. Pat. No. 2,493,748, "Merocyanines", L. G. S. Brooker et al. J.A.C.S., 73, 5326–5332 (1951) and L. G. S. Brooker et al. J.A.C.S., 73 5332–50 (1951). A general representative formula of such sensitizing merocyanine dyes is:

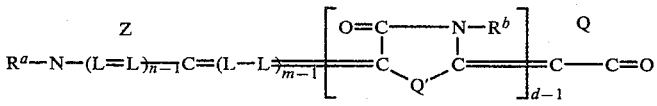

wherein $R^a$ and $R^b$ independently represent a member selected from the group consisting of an alcohol radical and an aryl group (preferably phenyl or substituted phenyl), L represents a methine group, n is 1 or 2, m is 1, 2 or 3, d is 1, 2 or 3, Q represents the non-metallic atoms (preferably C, S, Se, N and O) necessary to complete a 5-, 6-, or 7-membered heterocyclic nucleus (which may be substituted as with a sulfonalkyl or carboxyalkyl group) which may be present in a metal or ammonium salt form of the heterocyclic nucleus, Q' being selected from the group of oxygen, sulfur and

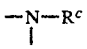

wherein $R^c$ is selected from the group consisting of an alcohol radical and an aryl group, and Z represents the non-metallic atoms (preferably selected from C, N, Se, S or O) to complete a 5- or 6-membered heterocyclic nucleus. "Simple" and generally preferred merocyanines have the above structure where d=1. Preferred merocyanines for the present invention have the structure

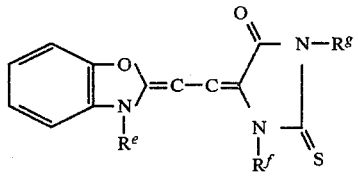

wherein $R^e$ is alkyl of up to 12 carbon atoms, preferably 2 to 8 carbon atoms and most preferably ethyl, $R^f$ is aryl of 6 to 10 carbon atoms, sulfoalkyl or carboxyalkyl of 1 to 12 carbon atoms in the alkyl, preferably phenyl or 1 to 8 carbon atoms in the alkyl, and most preferably phenyl or $CH_2COOH$, and $R^g$ is aryl of 6 to 10 carbon atoms or alkyl of 1 to 12 carbon atoms, preferably phenyl or alkyl of 2 to 8 carbon atoms, and most preferably phenyl or ethyl. Substitution of the benzene ring with common substituents such as alkyl, alkoxy, halogen, aryl and the like are of course allowable and anticipated in the practice of the present invention.

The emulsions may be hardened in the usual manner, for example, with formaldehyde or halosubstituted aldehydes which contain a carboxyl group, such as mucobromic acid, diketones, methanesulfonic acid esters, dialdehydes and the like.

The silver halide emulsions according to the invention may contain other stabilizers in addition to those described above, preferably tetra- or penta-azaindenes and especially those which are substituted with hydroxyl or amino groups. Compounds of this type have been described in the article by Birr in "Zeitschrift fur Wissenschaftliche Photographic," volume 47, 1952, page 2 to 28. The emulsions may also contain heterocyclic mercapto compounds such as mercapto tetrazoles or mercury compounds as stabilizers.

The minimum stabilizing system according to the present invention comprises from 5 to 95% by weight of a uracil (including the thiouracils also known as the 2-mercapto-4-hydroxy-pyrimidines) and from 95 to 5% by weight of a phenol derivative having the formula

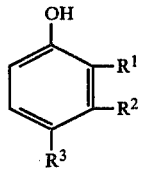

wherein $R^1$ is selected from the group consisting of aldoxime, amides (e.g., $$-\underset{\underset{R^4}{|}}{CONR^5}$$

wherein $R^4$ and $R^5$ are selected from the group consisting of H and alkyl (up to 12 carbon atoms but, preferably of 1 to 4 carbon atoms), anilide, or ester ($-COOR^6$, wherein $R^6$ is selected from the group consisting of alkyl of 1 to 12 carbon atoms, phenyl, or alkylphenyl with no more than four carbon atoms in the alkyl of the alkylphenyl), $R^2$ and $R^3$ are selected from hydrogen, hydroxy, alkoxy of 1 to 12 carbon atoms, or alkyl of 1 to 12 carbon atoms, or may be the atoms necessary to form a fused-on benzene ring. Preferably at least one of $R^2$ and $R^3$ are hydrogen and most preferably, $R^1$ is aldoxime ($-C{=}NOH$) and both $R^2$ and $R^3$ are hydrogen (hereinafter this most preferred phenol will be referred to as SCA for salicylaldoxime) The preferred uracils are the 2-mercapto-4-hydroxy-pyrimidines and especially the 2-mercapto-4-hydroxy-6-alkyl-pyrimidines (with the alkyl groups 1–20, preferably 1–12 and most preferably 1–4 carbon atoms).

The stabilizer system of the present invention may further comprise up to 50 percent by weight of manganous salts preferably 5 to 45%), up to 45 percent by weight lithium salt (preferably 5 to 40 percent), and up to 15 percent by weight of pyrimidine stabilizers (preferably 0.5 to 10 percent). Other stabilizers known in the art may, of course, be added to the emulsion. The lithium and manganous salts may, for example, be nitrate, sulfate, or halide (e.g., bromide and chloride) salts. Any watersoluble inorganic salt of lithium and manganese (II) are particularly useful. The pyrimidine compounds particularly useful in the present inventions are preferably triazolopyrimidines and may be represented by the formula:

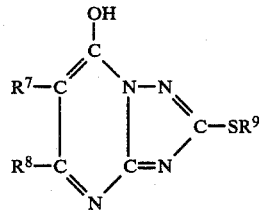

wherein $R^7$ is selected from hydrogen, alkyl, alkaryl, aryl, alicyclic or heterocyclic (preferably each of which has no more than 12 carbon atoms and where the heterocyclic is comprised of only, C, S, N and O atoms. The alkyl groups are more preferably 1 to 4 carbon atoms), $R^8$ is selected from alkyl, aralkyl, aryl, alicyclic, heterocyclic, hydroxy, amino or carbylalkoxy (preferably with up to 12 carbon atoms and where the heterocyclic is comprised of only C, S, N and O atoms. The alkyl groups are most preferably 1 to 4 carbon atoms), and $R^9$ is selected from hydrogen, alkyl and aralkyl of up to 12 carbon atoms, preferably 1 to 4 carbon atoms in the alkyl.

$R^7$ and $R^8$ may also represent the atoms necessary to form a fused-on benzene ring. Preferably, $R^7$ is hydrogen or alkyl of 1 to 4 carbon atoms, $R^8$ is hydrogen or alkyl of 1 to 4 carbon atoms and $R^9$ is hydrogen or alkyl of 1 to 4 carbon atoms. Most preferably, $R^7$ is hydrogen and $R^8$ and $R^9$ are methyl. This most preferred pyrimidine is hereinafter referred to as MPP.

Any substrate may be used in the practice of the invention. Conventional substrates such as polymeric film (e.g., polyester, cellulose acetate and the like), paper, etc. may be used.

Rapid access development chemistry usually comprises high sulfite content hydroquinone developer solutions which are aerially stable and are often capable of producing high contrast images. Metol or phenidone are usually included in the solution.

Practice of the present invention will be further illustrated by the following examples. In all examples, a standard rapid access processable negative film was prepared on polyester. The emulsion comprised a 64/36 chlorobromide emulsion doped with rhodium according to conventional precipitation techniques. The emulsion was also conventionally chemically sensitized with thiosulfate and gold and spectrally sensitized with a merocyanine sensitizing dye. All emulsions were also stabilized with 8 ml/M (of silver halide) of a 5 Molar aqueous solution of lithium nitrate, and 12 ml/M of a 1.5 M aqueous solution of manganous nitrate. All emulsions were coated, sensitometrically exposed and rapid access processed for 20 seconds at 106° F. in a commercially available 3M RA-24 processor with the chemistry described in "Photographic Processing Chemistry", L. F. A. Mason, Wiley Press, 1975, p. 142 as the D62 developer.

EXAMPLES

The following stabilizers were added to the standard emulsion in various amounts, potassium bromide, 6-methyl-2-thiouracil (hereinafter MTU), and salicylaldoxime (hereinafter SCA). One portion of each photographic element was immediately exposed and developed while a second portion was incubated for sixty hours at 60° C. in a sealed bag. The second portion was then exposed and developed in an identical manner. Measurements were taken of the speed and the contrast ($\theta C$ is overall contrast, $\theta A$ is toe contrast). Speed is recorded as the relative log of the reciprocal exposure at the point where density is 0.2 above $D_{min}$. Contrast is the slope of the D vs LogE curve taken between 0.5 and 2.5 density above $D_{min}$. Toe contrast is the slope between 0.07 and 0.17 above $D_{min}$. The change in speed ($\Delta$Speed) and change in contrast ($\Delta\theta C$ or $\Delta\theta A$) were readily determined by subtracting the initial value from the value after incubation. The data were as follows:

| Example | Additive | Amount | Speed | ΔSpeed | θC | ΔθC |
|---|---|---|---|---|---|---|
| 1 | 0 | 0 | 0.58 | +.37 | 8.6 | −3.0 |
| 2 | KBr | 27 ml/M 1N | 0.55 | +.33 | 8.6 | −2.7 |
| 3 | MTU | 100 mg/M | 0.59 | +.36 | 8.7 | −3.1 |
| 4 | MTU | 200 mg/M | 0.59 | +.32 | 8.8 | −2.7 |
| 5 | KBr and MTU | 27 ml/M 1N 100 mg/M | 0.54 | +.33 | 8.8 | −3.0 |

-continued

| Example | Additive | Amount | Speed | ΔSpeed | θC | ΔθC |
|---|---|---|---|---|---|---|
| 6 | KBr and MTU | 27 ml/M 1N 200 mg/M | 0.55 | +.21 | 9.2 | −2.3 |

In the next five examples, all samples also contained 12 ml per mole of silver halide of a one molar aqueous solution of KBr.

| | | | | | | |
|---|---|---|---|---|---|---|
| 7 | MPP | 20 ml/M 1% | 0.57 | +.30 | 9.77 | −2.87 |
| 8 | MTU | 200 mg/M | 0.49 | +.35 | 8.87 | −2.75 |
| 9 | MTU | 400 mg/M | 0.43 | +.37 | 9.07 | −1.95 |
| 10 | SCA | 12 ml/M 10% | 0.35 | +.31 | 6.30 | −1.10 |
| 11 | MTU and SCA | 400 mg/M 12 ml/M 10% | 0.39 | +.07 | 9.45 | −1.55 |

Several observations are apparent. There is both some gain in contrast and actual loss of speed with higher concentrations of 6-methyl-2-thiouracil. Neither 6-methyl-2-thiouracil nor salicylaldoxime show significant speed loss stabilization properties by themselves, although some minor effects were noted in Examples 3 and 4. The combination of the uracil and the substituted phenol (the salicylaldoxime) showed a dramatic reduction in speed gain on incubation. This is particularly surprising in view of the fact that the substituted phenols are thought to be only antifoggants (e.g., U.K. Pat. No. 988,052) and are not taught as stabilizers. Furthermore, not only is the speed increase reduced, but the contrast loss is also diminished by the combination of the uracil and the nitroso-substituted phenol. Although these additives cause some initial loss of speed in the emulsion, the oridinarily skilled photographic and emulsion chemist could regain that lost speed by known adjustments in the properties and characteristics of the silver halide grains, such as their size.

The most preferred compositions for maximizing speed and contrast with minimum speed gain and contrast loss with the standard emulsion used in the examples of the present invention were found to contain approximately 8 ml/M 5M $LiNO_3$, 12 ml/M 1.5M $Mn(NO_3)_2$, 20 ml/M 1% MPP, 12 ml/M 10% salicylaldoxime, 12 ml/M 1M KBr, and 300 to 400 mg/M MTU. The data for such compositions appears below:

| Example | MTU (mg) | Speed 0.2 | Δ Speed | θA | ΔθA | θC | ΔθC |
|---|---|---|---|---|---|---|---|
| 11 | 300 | 0.66 | +.12 | 1.53 | −.39 | 8.89 | −1.50 |
| 12 | 400 | 0.58 | +.16 | 1.57 | −.46 | 9.52 | −2.42 |

We claim:

1. A photographic silver halide emulsion in a hydrophilic binder having therein a speed stabilizing amount of a stabilizing system comprising 5 to 95 percent by weight of said system of a uracil and from 95 to 5 percent by weight of said system of a substituted phenol of the formula:

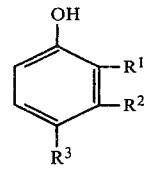

wherein $R^1$ is selected from the group consisting of aldoxime, amide, anilide, and ester, $R^2$ and $R^3$ are selected from the group consisting of hydrogen, hydroxy, alkoxy, and alkyl, with at least one of $R^2$ and $R^3$ being hydrogen or together $R^2$ and $R^3$ form a fused-on benzene ring.

2. The emulsion of claim 1 wherein said stabilizing amount comprises from 0.05 to 12 gram of stabilizing system per gram mole of silver halide, $R^1$ is selected from the class consisting of $$-CH{=}NOH,\ -CON(R^5)R^4,\ \text{and}\ -COOR^6$$

wherein $R^4$ and $R^5$ are independently selected from the group consisting of hydrogen, alkyl of 1 to 12 carbon atoms, and phenyl, with no more than one of $R^4$ and $R^5$ being phenyl, and $R^6$ is selected from the group consisting of alkyl of 1 to 12 carbon atoms, phenyl, or alkylphenyl of no more than 12 carbon atoms, and $R^2$ and $R^3$ are selected from the group consisting of hydrogen and alkyl of 1 to 12 carbon atoms.

3. The emulsion of claim 1 wherein said silver halide grains are doped with rhodium.

4. The emulsion of claim 2 wherein said silver halide grains are doped with rhodium.

5. The emulsion of claim 4 wherein said substituted phenol is an aldoxime of the formula:

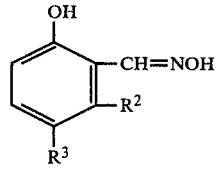

wherein $R^2$ and $R^3$ are selected from the group consisting of hydrogen and alkyl of 1 to 4 carbon atoms.

6. The emulsion of claim 1 wherein said uracil is a 2-mercapto-4-hydroxy-pyrimidine.

7. The emulsion of claim 4 wherein said uracil is a 2-mercapto-4-hydroxy-6-alkyl-pyrimidine.

8. The emulsion of claim 5 wherein said uracil is a 2-mercapto-4-hydroxy-6-alkyl-pyrimidine.

9. The emulsion of claims 2, 4, 6, or 7 wherein water insoluble lithium salt stabilizers, manganous salt stabilizers, and triazolopyrimidines are also present in stabilizing amounts and the total stabilizing amount of said stabilizers and stabilizing system comprises from 0.05 to 12 g per gram mole of silver halide.

10. The emulsion of claim 9 wherein a spectrally sensitizing amount of a merocyanine dye is also present in the emulsion.

11. A photographic silver halide emulsion in a hydrophilic binder having therein a speed stabilizing amount of a stabilizing system comprising 5 to 95 percent by weight of said system of a uracil and from 95 to 5 percent by weight of said system of a substituted phenol which is an aldoxime of the formula:

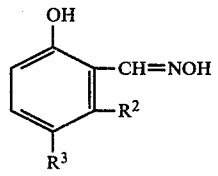

wherein $R^2$ and $R^3$ are selected from the group consisting of hydrogen and alkyl of 1 to 4 carbon atoms, said stabilizing amount comprises from 0.05 to 12 gram of stabilizing system per gram mole of silver halide, and said silver halide grains of said emulsion are doped with rhodium.

12. The emulsion of claims 5 or 8 wherein water soluble lithium salt stabilizers, manganous salt stabilizers, and triazolopyrimidines are also present in stabilizing amounts and the total stabilizing amount of said stabilizers and stabilizing system comprises from 0.05 to 12 g per gram mole of silver halide.

13. A photographic silver halide emulsion of claim 12 having therein a speed stabilizing amount of a stabilizing system comprising 5 to 95 percent by weight of said system of a uracil and from 95 to 5 percent by weight of said system of a substituted phenol which is an aldoxime of the formula:

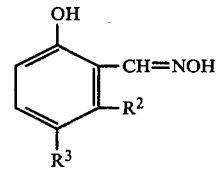

wherein $R^2$ and $R^3$ are selected from the group consisting of hydrogen and alkyl of 1 to 4 carbon atoms, said stabilizing amount comprises from 0.05 to 12 gram of stabilizing system per gram mole of silver halide, said silver halide grams of said emulsion are doped with rhodium.

* * * * *